US008245888B2

(12) United States Patent
Andersen et al.

(10) Patent No.: US 8,245,888 B2
(45) Date of Patent: Aug. 21, 2012

(54) BARRIER PISTON WITH SEAL

(75) Inventors: Daniel A. Andersen, Burlington, WI (US); Lawrence M. Brown, Franksville, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 670 days.

(21) Appl. No.: 12/257,497

(22) Filed: Oct. 24, 2008

(65) Prior Publication Data

US 2010/0102091 A1 Apr. 29, 2010

(51) Int. Cl.
*B67D 7/60* (2010.01)
*G01F 11/00* (2006.01)

(52) U.S. Cl. ..... 222/389; 222/386; 277/436; 277/448

(58) Field of Classification Search ..... 222/386–388, 222/392, 389; 277/436, 437, 438, 440; 264/259, 264/271.1, 273, 274, 279; 92/172, 242, 254; 604/222

See application file for complete search history.

(56) References Cited

U.S. PATENT DOCUMENTS 3,388,638 A 6/1968 Brinkel
3,433,134 A 3/1969 Vellekoop
3,595,449 A 7/1971 Stump et al.
3,827,607 A 8/1974 Schultz
3,901,416 A 8/1975 Schultz
4,023,717 A 5/1977 Schultz
4,106,674 A 8/1978 Schultz
4,109,833 A 8/1978 Gross
4,171,757 A 10/1979 Diamond
4,214,507 A 7/1980 Hock et al.
4,234,108 A 11/1980 Diamond
4,402,427 A 9/1983 Muskovin et al.
4,506,810 A 3/1985 Goncalves
4,562,942 A 1/1986 Diamond
4,641,765 A 2/1987 Diamond
4,645,098 A 2/1987 Hoffmann
4,703,875 A 11/1987 Malek
4,834,347 A 5/1989 Pauliukonis
4,913,323 A 4/1990 Scheindel
5,065,900 A 11/1991 Scheindel
5,127,556 A * 7/1992 Sporri ..... 222/389
5,165,577 A 11/1992 Ophardt
5,282,552 A 2/1994 Ophardt
5,392,962 A 2/1995 Meshberg
5,419,466 A 5/1995 Scheindel
5,441,181 A 8/1995 Scheindel
5,577,641 A 11/1996 De Laforcade et al.
5,702,736 A 12/1997 Henein
5,850,948 A 12/1998 Garcia et al.
5,902,276 A * 5/1999 Namey, Jr. ..... 604/218
5,975,360 A 11/1999 Ophardt
6,325,254 B1 12/2001 Diamond
6,343,713 B1 2/2002 Abplanalp
6,371,338 B1 4/2002 Klein et al.
RE38,207 E 8/2003 Benoist
6,651,850 B2 11/2003 Abplanalp
6,745,920 B2 6/2004 Gupta
2002/0056368 A1 5/2002 May (Continued)

*Primary Examiner* — Kevin P Shaver
*Assistant Examiner* — Daniel R Shearer

(57) ABSTRACT

A barrier piston with an integrated seal for use with aerosol containers is disclosed. The barrier piston includes a piston body with flow channels disposed on the surface thereof. Stabilizers of a low durometer material are provided on the flow channels to prevent tilting and binding of the piston body within a container. A seal also of a low durometer material is disposed on the base of the piston body to ensure separation of the product and propellant.

7 Claims, 5 Drawing Sheets

U.S. PATENT DOCUMENTS

| | | | |
|---|---|---|---|
| 2002/0162450 | A1 | 11/2002 | Frost |
| 2003/0019888 | A1 | 1/2003 | Gupta |
| 2003/0071080 | A1 | 4/2003 | Yquel |
| 2003/0102328 | A1 | 6/2003 | Abplanalp et al. |
| 2004/0016777 | A1 | 1/2004 | Gupta |
| 2004/0134929 | A1 | 7/2004 | Scheindel |
| 2005/0242118 | A1 | 11/2005 | Van der Heijden |
| 2006/0162807 | A1 | 7/2006 | Mackenzie et al. |
| 2008/0041885 | A1 | 2/2008 | Costa et al. |

* cited by examiner

FIG. 3A
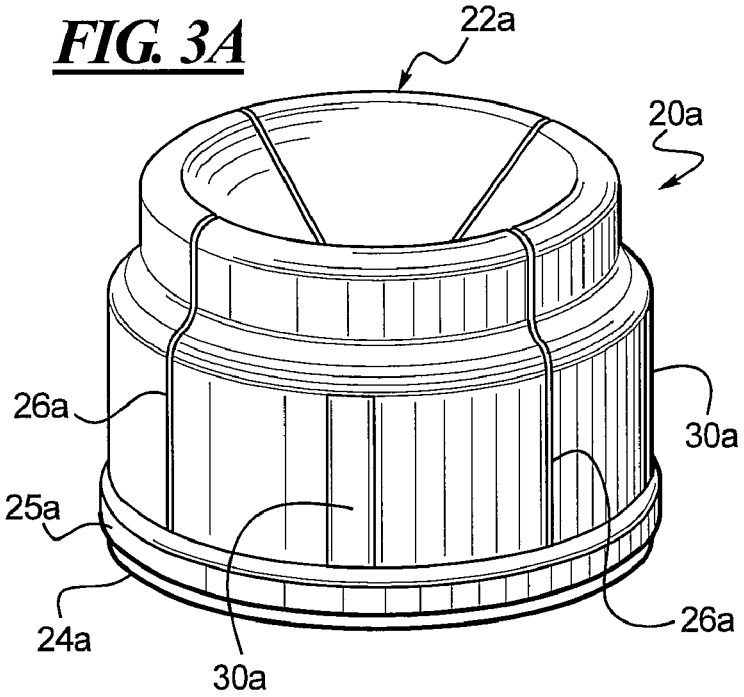
FIG. 3B
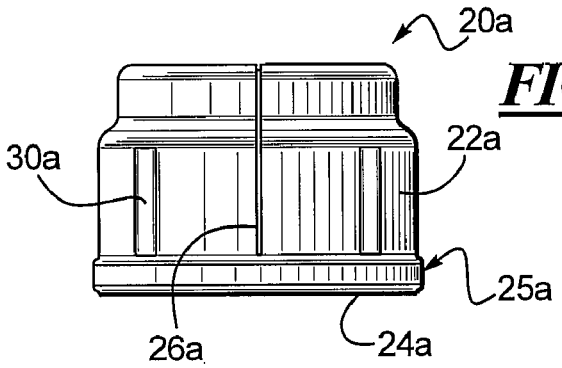
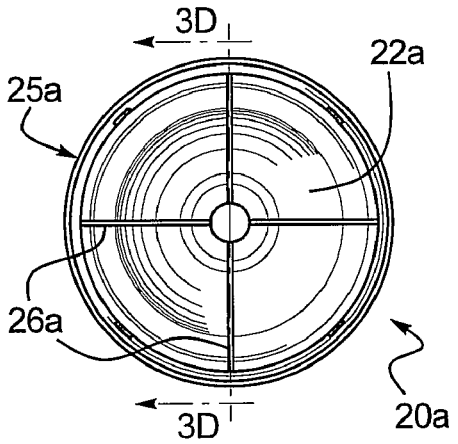
FIG. 3C
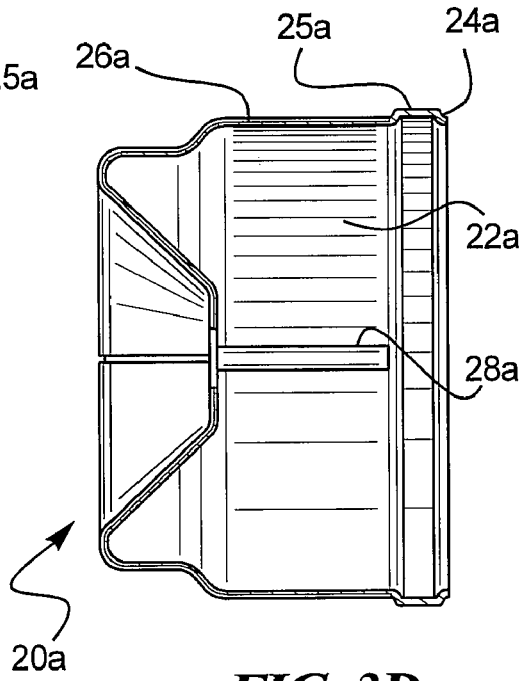
FIG. 3D

FIG. 4A
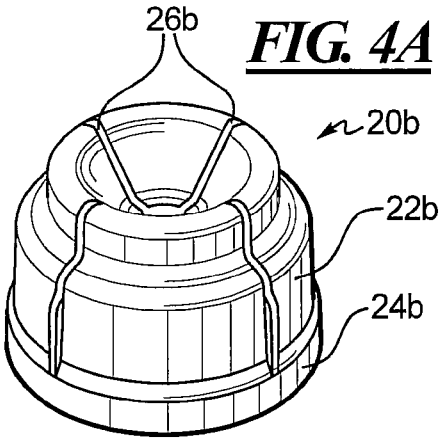
FIG. 4B
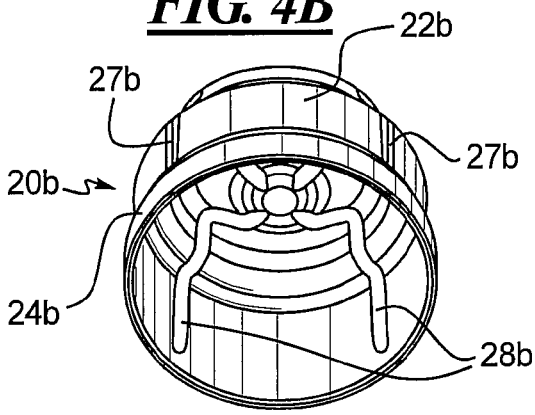
FIG. 4C
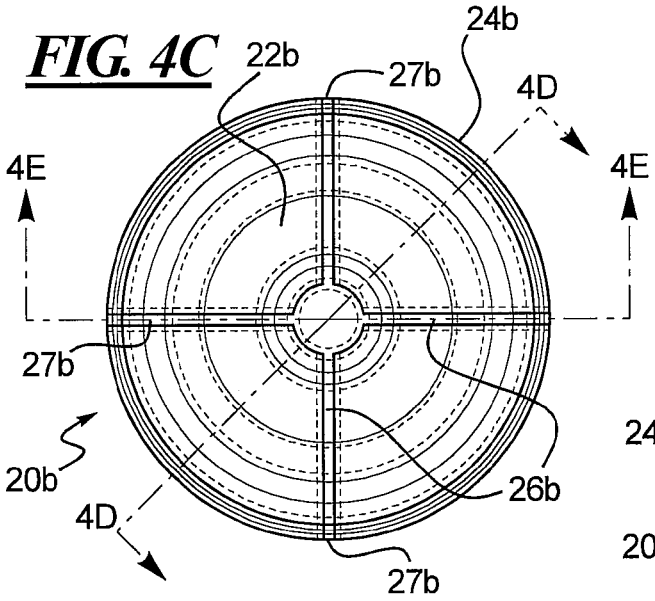
FIG. 4D
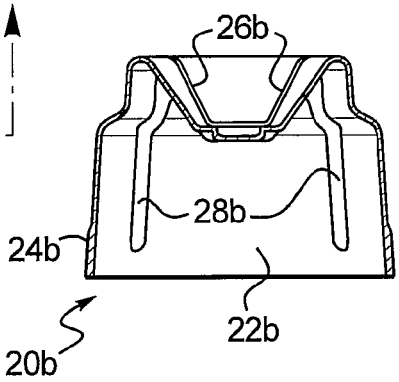
FIG. 4E
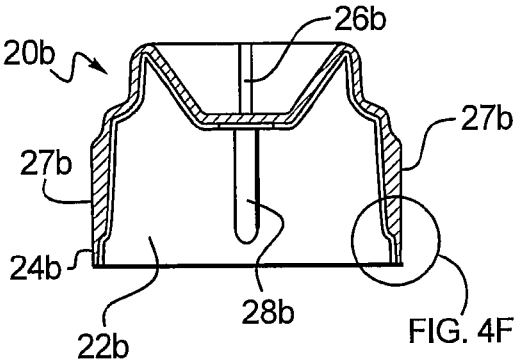
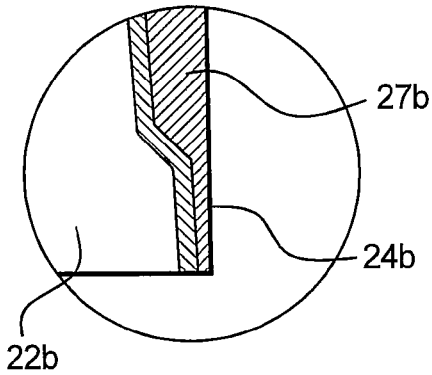
FIG. 4F

BARRIER PISTON WITH SEAL

FIELD OF THE DISCLOSURE

The present disclosure relates to aerosol containers, and more particularly, relates to a barrier piston with an integrated seal of low durometer to ensure separation of the product and propellant within such aerosol containers.

BACKGROUND OF THE DISCLOSURE

Aerosol containers have been commonly used to dispense personal, household, industrial, and medical products, and to provide a low cost, easy to use method of dispensing a product. Typically, aerosol containers include a product to be dispensed and a propellant used to discharge the product from the container. The propellant is under pressure and provides a force to expel the product when a user actuates the aerosol container.

More specifically, the product to be dispensed can include volatile actives such as fragrances, sanitizers, cleaners, waxes or other surface treatments, deodorizers and or insect control agents such as repellents, insecticides, or growth regulators. One or more chemicals to be dispensed are usually mixed in a solvent and, in any event, are mixed with the propellant. Typical propellants are compressed air or other compressed gases, carbon dioxide, a selected hydrocarbon gas, or mixtures of hydrocarbon gases, such as a propane-butane mix. The mixture is then sprayed out of the container by manually pushing down or sideways on an actuator button, lever, or other structure that controls a valve assembly mounted at the top of the container.

The two main types of propellants used in aerosol containers today are liquefied gas propellants, such as hydrocarbon and hydrofluorocarbon (HFC) propellants, and compressed gas propellants, such as compressed carbon dioxide or nitrogen gas. To a lesser extent, chlorofluorocarbon propellants (CFCs) are also used. The use of CFCs is, however, being phased out due to the harmful effects of CFCs on the environment. Hydrocarbon propellants contain Volatile Organic Compounds (VOCs). The content of VOCs in aerosol air fresheners is an unwanted byproduct and is consequently regulated by various federal and state regulatory agencies, such as the Environmental Protection Agency (EPA) and California Air Resource Board (CARB).

One way in which to reduce the VOC content released by aerosol containers is to reduce the content of the hydrocarbon propellant used to dispense the liquid product. However, a reduction in the propellant content adversely affects the product performance. Specifically, reducing the propellant content results in excessive amounts of the product remaining in the container at the end of the life of the dispenser assembly, and an increase in the size of particles of the dispensed product.

In other solutions, a piston is slidably sealed within the container and in between the product and the propellant so as to seal in the propellant. As the product is dispensed, the piston maintains pressure on the product and prevents release of the propellant by translating longitudinally within the container in contact with the inner wall of the container. For proper operation, the piston must form and maintain an effective seal with the inner wall of the container. If the piston fails to seal, the product to be dispensed may leak into the propellant. This leakage reduces the amount of product which can be dispensed. Moreover, for certain types of products and propellants, the leaked product may spoil. Additionally, when the piston seal fails, the propellant may leak into the product, which is known as blow by, and may also create problems.

Furthermore, discontinuities in the inner wall of a container make it difficult to maintain an effective seal between the piston and the side wall. Discontinuities can be either consistent, for example a seam, or random, for example a dent. Such discontinuities can cause the seal to fail or the piston to bind, or both. The likelihood of either seal failure or piston binding is dependent on both the longitudinal and radial rigidity of the piston. That is, a piston having a high radial rigidity is likely to leak or bind when it encounters a discontinuity. A piston having a high longitudinal rigidity is likely to bind when it encounters a discontinuity.

Existing piston designs incorporate a flexible skirt to provide an effective seal for an aerosol container. Accordingly, a common piston configuration is a one-piece molded plastic piston having a face portion and a flexible skirt for sealingly engaging the inner wall of the aerosol container. The plastic piston may also be manufactured by thermoforming, casting, pressing, extrusion, or any other process for manufacturing plastics. The longitudinal and radial rigidity of the piston are generally determined by the length and the thickness of the plastic skirt. One-piece molding or any other process of forming the piston, however, inherently limits how thin the skirt can be made. If the skirt is made too thin, molten plastic will not consistently and evenly fill the mold. If the skirt is made too thick, the piston will leak or bind.

Therefore, multiple needs exist for an improved aerosol container that minimizes the release of pollutants while performing efficiently and consistently throughout the life of the aerosol container. More specifically, needs exist for a barrier piston that isolates the product from the propellant, provides stability within the container, and conforms to variations in the container while using the pressurized propellant to discharge the product. Furthermore, needs exist for a more efficient method of molding such a barrier piston with an integrated seal.

SUMMARY OF THE DISCLOSURE

In accordance with one aspect of the disclosure, a barrier piston for an aerosol container is provided which comprises a piston body including a base, the piston body formed of a first material with a first durometer; and a seal molded onto the base of the piston body, the seal formed of a second material with a second durometer, the second durometer being less than the first durometer.

In accordance with another aspect of the disclosure, a barrier piston for an aerosol container is provided which comprises a piston body including a base and flow channels disposed thereon, the piston body formed of a first material with a first durometer; stabilizers formed of a second material with a second durometer disposed on the flow channels; and a seal formed of the second material radially disposed on the base of the piston body.

In accordance with another aspect of the disclosure, an aerosol container assembly is provided which comprises a container; a valve assembly disposed on a top of the container; a stopper sealed to a bottom of the container; and a barrier piston comprising a piston body with a base and flow channels disposed thereon, stabilizers disposed on the flow channels, and a seal radially disposed on the base, the barrier piston slidably disposed in an interior of the container between the valve assembly and the stopper, the valve assembly and the barrier piston defining a first chamber, the barrier piston and the stopper defining a second chamber.

In accordance with another aspect of the disclosure, a method of manufacturing a barrier piston with a seal is provided which comprises the steps of placing a mold core into a first cavity; injection molding a first material of a first durometer between the mold core and the first cavity to form a piston body having flow channels; removing the mold core and the piston body from the first cavity; placing the mold core and the piston body into a second cavity; injection molding a second material of a second durometer between the piston body and the second cavity to overmold stabilizers and a seal onto the piston body; removing the mold core and the piston body from the second cavity; and ejecting the piston body from the mold core.

These and other aspects of this disclosure will become more readily apparent upon reading the following detailed description when taken in conjunction with the accompanying drawings.

BRIEF DESCRIPTION OF THE DRAWINGS

FIG. 3A is a perspective view of another exemplary barrier piston;

FIG. 3B is a side view of the barrier piston of FIG. 3A;

FIG. 3C is a top view of the barrier piston of FIG. 3A;

FIG. 3D is a sectional view along line D-D of FIG. 3C;

FIG. 4A is a perspective view of another exemplary barrier piston;

FIG. 4B is perspective view of the bottom of the barrier piston of FIG. 4A;

FIG. 4C is top view of the barrier piston of FIG. 4A;

FIG. 4D is a sectional view along line D-D of FIG. 4C;

FIG. 4E is another sectional view along line E-E of FIG. 4C; and

FIG. 4F is a magnified view of the cutout F of FIG. 4E.

Figure 1A:
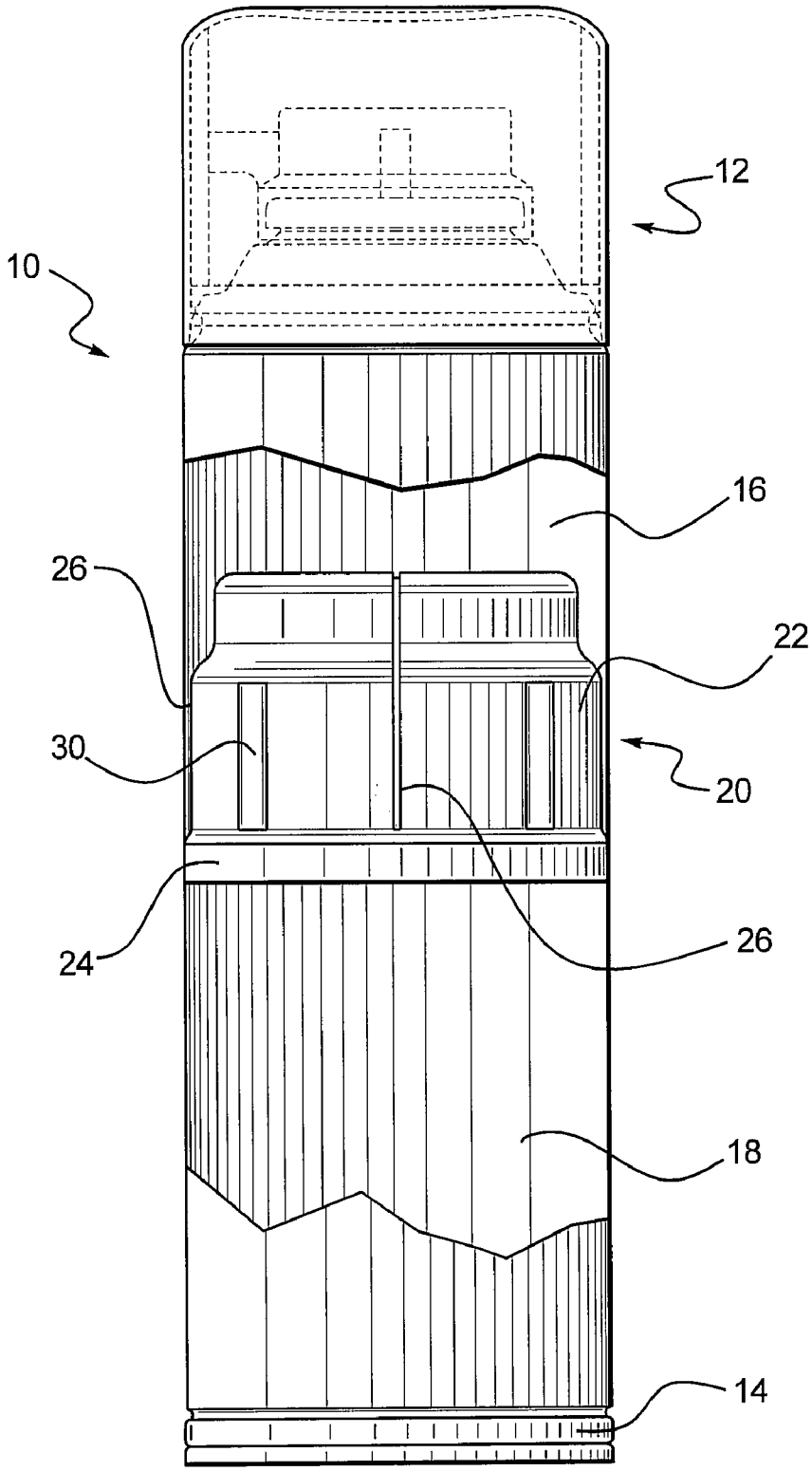
FIG. 1A is a sectional side view of an aerosol container using an exemplary barrier piston constructed in accordance with the teachings of the disclosure.

While the present disclosure is susceptible to various modifications and alternative constructions, certain illustrative embodiments thereof have been shown in the drawings and will be described below in detail. It should be understood, however, that there is no intention to limit the present invention to the specific forms disclosed, but on the contrary, the intention is to cover all modifications, alternative constructions, and equivalents falling with the spirit and scope of the present invention.

DETAILED DESCRIPTION

Figure 1B:
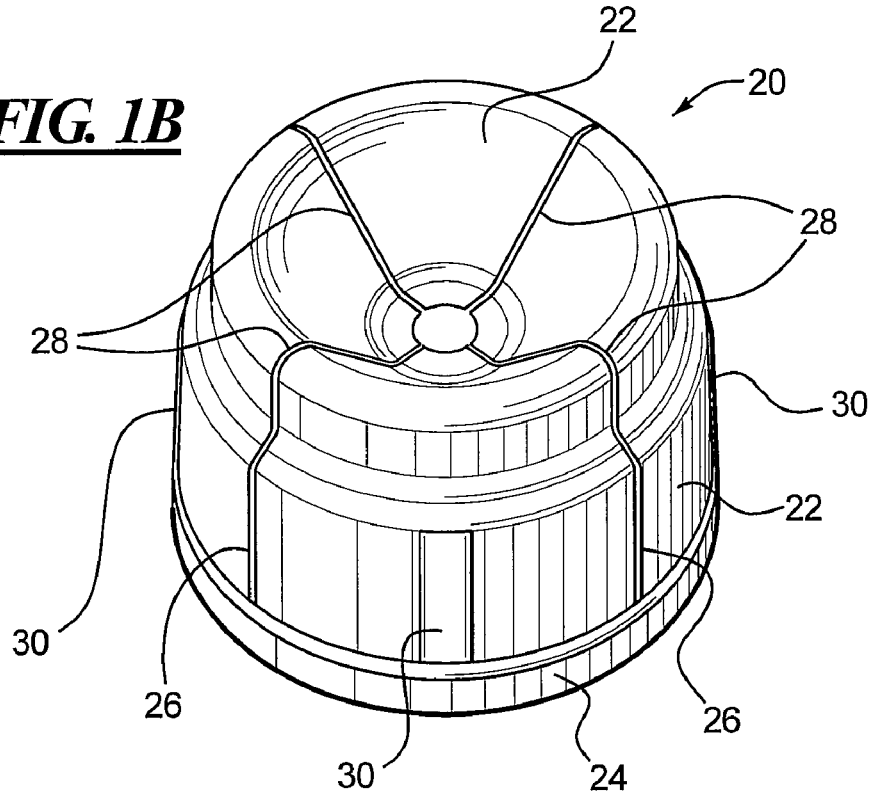
FIG. 1B is a perspective view of the barrier piston of FIG. 1A.

Referring now to the drawings and with particular references to FIGS. 1A and 1B, an exemplary aerosol container and a barrier piston for use with an aerosol container are referred to as reference numbers 10 and 20, respectively. It is understood that the teachings of the disclosure can be used to construct barrier pistons and related aerosol containers above and beyond that specifically disclosed below. One of ordinary skill in the art will readily understand that the following are exemplary embodiments.

One example of an aerosol container that may use a barrier piston to dispense liquid products is shown in FIG. 1A. The aerosol container 10 may include a valve assembly 12 on the top of the container 10 and a stopper 14 sealed to the bottom. A barrier piston 20 may be slidably disposed between the valve assembly 12 and the stopper 14 to define a first chamber 16 and a second chamber 18. The first chamber 16 may comprise a product to be dispensed while the second chamber 18 may comprise a propellant. The product to be dispensed may include actives such as fragrances, sanitizers, cleaners, waxes, deodorizers and or insect control agents. Typical propellants may include compressed gas, liquefied gas, or the like.

The propellant in the second chamber 18 may be pressurized such that a constant upward force is exerted on the barrier piston 20. Similarly, pressure in the first chamber 16 may exert an opposing force on the barrier piston 20. Accordingly, the barrier piston 20 may slidably adjust its longitudinal position within the container 10 until pressure equilibrium has been reached. In use, the product may be discharged from the container 10 by manually actuating a button, switch, latch, lever, or the like, that controls the valve assembly 12. Upon actuation, pressure may be released from the first chamber 16, which may offset the pressure equilibrium. More specifically, the pressure in the second chamber 18 may be greater than that of the first chamber 16. Accordingly, the barrier piston 20 may slide toward the top of the container 10 until pressure equilibrium between the first and second chambers 16, 18 is restored.

As shown in more detail in FIG. 1B, the barrier piston 20 may include a piston body 22 with additional features that ensure a consistent seal between the first and second chambers 16, 18. For instance, a seal 24 may be radially disposed, or molded, on a base of the piston body 22 to seal any gap that may exist between the piston body 22 and the inner walls of the container 10. The piston body 22 may be made of a first material while the seal 24 may be made of a second material of low durometer, such that an effective seal is maintained between the piston body 22 and any discontinuities that may exist along the inner wall of the container 10. In certain embodiments, the piston body 22 may be a thermoplastic material while the seal 24 may be a thermoplastic elastomer material. Additionally, other comparative materials may be used to form the piston body 22 and the seal 24.

The barrier piston 20 of FIG. 1B may further include flow channels 28 through which a set of stabilizers 26 may traverse the surface of the piston body 22. In the depicted embodiment, four stabilizers and flow channels are shown but alternatively, fewer or a greater number of stabilizers 26 and flow channels 28 may be distributed on the barrier piston 20. Flow channels 28 may be formed on the piston body 22 in the form of grooves, paths, or the like, and facilitate overmolding of a seal 24 and stabilizers 26 onto the piston body 22. Additionally, flow channels 28 may frictionally hold the seal 24 and the stabilizers 26 firmly in place. For instance, stabilizers 26 may be at least partially embedded or molded into the flow channels 28. In alternate embodiments, the stabilizers 26 may be integrated into the piston body 22, completely external to the piston body 22, or any combination thereof.

Referring back to FIG. 1A, stabilizers 26 help the piston body 22 maintain axial alignment within the container 10 during longitudinal movements. Alignment strips 30 may also be disposed on a surface of the piston body 22 to provide more axial stability. To further prevent tilting or binding of the piston body 22 within the container 10 in the presence of discontinuities, the stabilizers 26 may be made of a low durometer material, for example, thermoplastic elastomer. Thermoplastic elastomer material may provide the stabilizers 26 with enough flexibility to compensate for dents and or other discontinuities that may exist along the inner walls of the container 10.

Figure 2A:
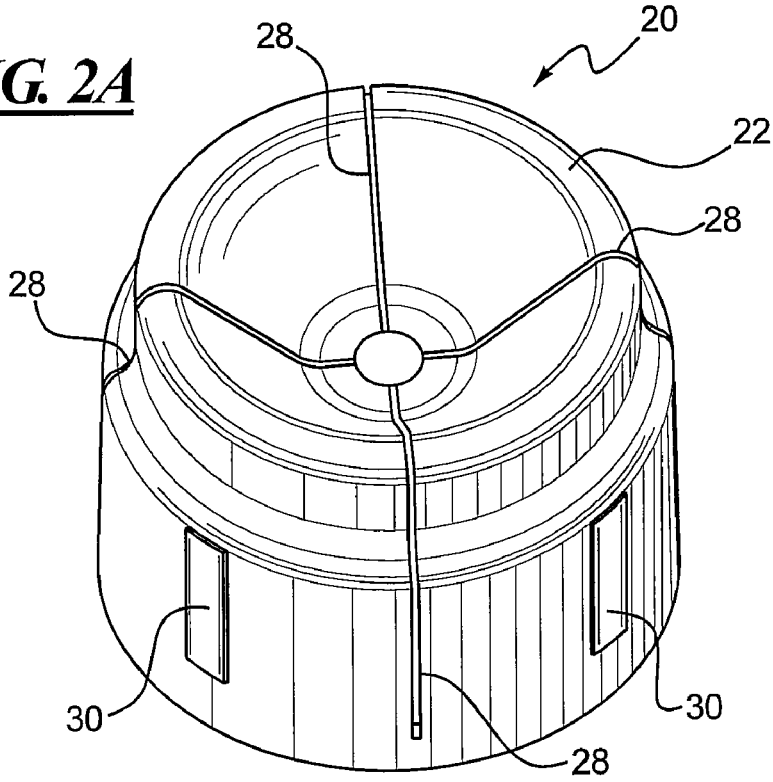
FIG. 2A is a perspective view of the piston body of the barrier piston of FIGS. 1A and 1B.
Figure 2B:
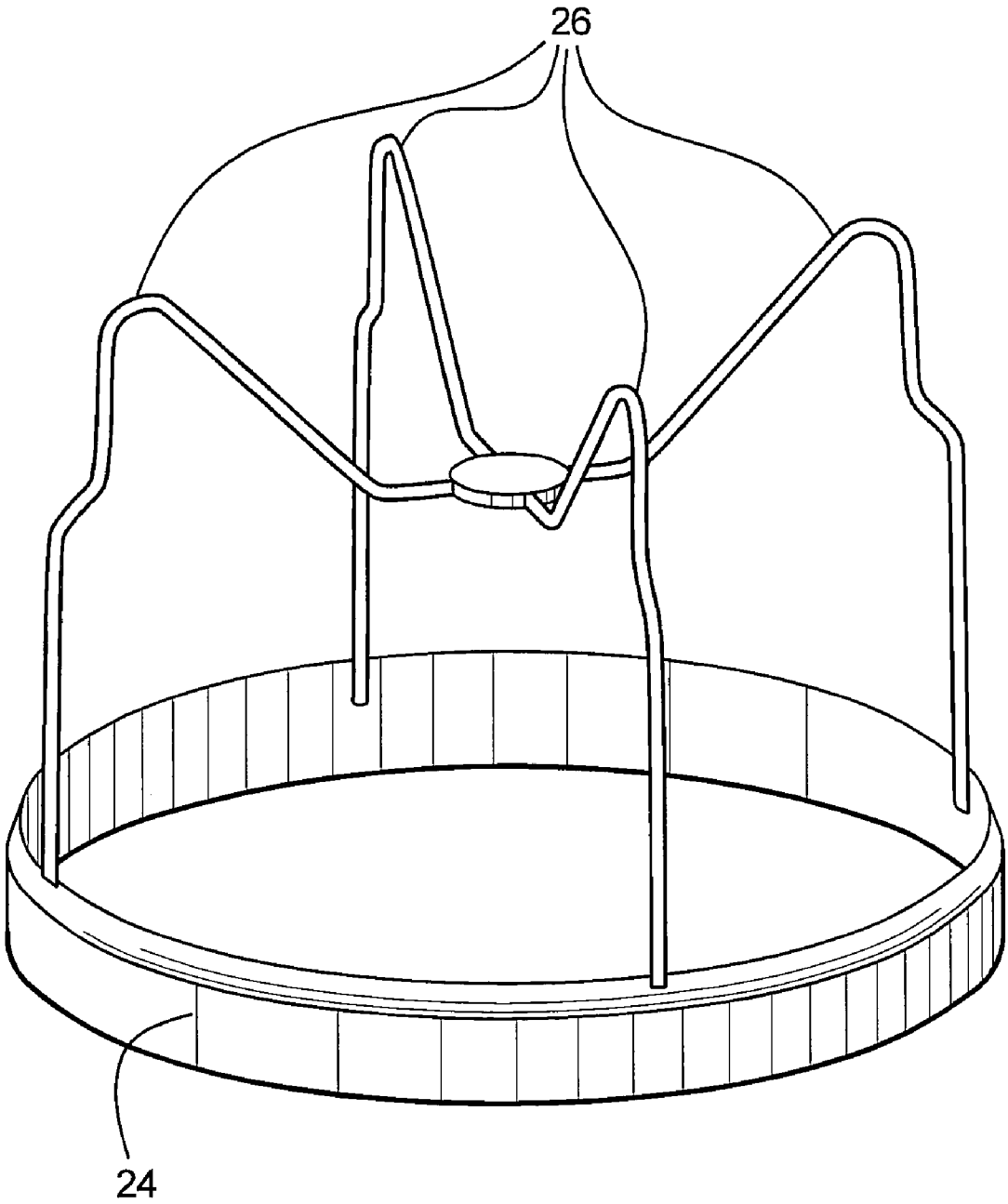
FIG. 2B is a perspective view of the seal and stabilizers of the barrier piston of FIGS. 1A and 1B.

Referring now to FIGS. 2A and 2B, individually molded components of the barrier piston 20 of FIG. 1B are provided. As described above, the completed barrier piston 20 may comprise more than one material, and accordingly, manufacture of the barrier piston 20 may include a multi-step injection molding or overmolding process. More specifically, a two-step injection molding process may be used to mold the piston body 22 using a first material, and to mold the combination of the seal 24 and the stabilizers 26 using a second material of low durometer. Alternatively, additional steps may be employed for molding barrier pistons comprising additional materials.

Manufacture of the barrier piston 20 may include the following two-step injection molding process. First, a mold core may be placed into a first cavity for forming the piston body 22 of FIG. 2A having flow channels 28 and alignment strips 30. A first material, for example a thermoplastic, may be injection molded between the mold core and the first cavity. The mold core and the piston body 22 may then be removed from the first cavity. Next, the mold core and the piston body 22 may be placed into a second cavity for overmolding the seal 24 and the stabilizers 26 of FIG. 2B onto the piston body 22. A second material of low durometer, for example a thermoplastic elastomer, may be injection molded between the mold core and the second cavity. Subsequently, the mold core and the completed barrier piston 10 may be removed from the second cavity. Finally, the completed barrier piston 20 may be ejected from the mold core.

Referring now to FIGS. 3A-3D, views of another exemplary barrier piston 20*a* is provided. As with the previous embodiment, a piston body 22*a* may be provided with flow channels 28*a* and alignment strips 30*a*. Furthermore, a seal 24*a* and a set of stabilizers 26*a* of a low durometer material may be disposed on the piston body 22*a*. In contrast to the seal 24 of FIGS. 1B and 2B, the seal 24*a* of FIGS. 3A and 3B may further comprise a rib 25*a*. Alternatively, the seal 24*a* may include a plurality of smaller ribs 25*a*.

Referring now to FIGS. 4A-4F, views of yet another exemplary barrier piston 20*b* is provided. As with previous embodiments, the piston body 22*b* may be provided with flow channels 28*b* and stabilizers 26*b* disposed thereon. A seal 24*b* may also be radially disposed on the bottom or base of the piston body 22*b*. In contrast to the barrier pistons 20, 20*a* described above, the piston body 22*b* may be formed without alignment strips. Accordingly, the stabilizers 26*b* may include extensions 27*b* that are longitudinally flush with the seal 24*b* to compensate for the absent alignment strips. Using the stabilizers 26*b* and extensions 27*b* as guides, the barrier piston 20*b* may be able to maintain axial alignment within an aerosol container. More specifically, the extensions 27*b* of a low durometer material may prevent tilting and binding of the barrier piston 20*b* within an aerosol container in the presence of dents and or other discontinuities.

Manufacture of the barrier pistons 20*a*, 20*b* may essentially include the same aforementioned two-step injection molding process but with minor differences. For manufacturing the embodiment of FIGS. 3A-3D, the seal 24*a* may be injection molded to include the rib 25*a*. For manufacturing the embodiment of FIGS. 4A-4F, the piston body 22*b* may be injection molded without alignment strips, and the stabilizers 26*b* may be injection molded to include the extensions 27*b* described above. Similar modifications to the injection molding process may be applied for molding any additional features to the barrier piston design.

Based on the foregoing, it can be seen that the present disclosure provides a barrier piston with features that ensure separation of the product and propellant. A seal and a set of stabilizers of a low durometer material prevent tilting and binding of the piston body in the presence of discontinuities within the walls of an aerosol container. Moreover, the stabilizers preserve the position and alignment of the seal on the base of the piston body. Furthermore, a preferred method of overmolding the seal and stabilizers of a low durometer material upon a piston body with flow channels is provided. The overmolding process provides a supported seal while also facilitating manufacture of the barrier piston.

While only certain embodiments have been set forth, alternatives and modifications will be apparent from the above description to those skilled in the art. These and other alternatives are considered equivalents and within the spirit and scope of this disclosure.

What is claimed is:

1. A barrier piston for an aerosol container, comprising:

a piston body including a base and flow channels disposed thereon, the piston body formed of a first material with a first durometer, the flow channels including first and second channels disposed perpendicularly from each other;

a seal formed of a second material with a second durometer radially disposed on the base of the piston body and being adapted to separate propellant from product when the barrier piston is positioned within the aerosol container;

stabilizers formed of the second material disposed in the flow channels, the stabilizers and seal being overmolded onto the piston body as a unitary body, the stabilizers each including a longitudinally oriented extension, each extension being non-circumferential and discreet from one another, each extension having an outer diameter that is longitudinally flush with an outer diameter of the seal and sized to abut an inner surface of the aerosol container.

2. The barrier piston of claim 1, wherein the first material is a thermoplastic material and the second material is a thermoplastic elastomer material.

3. The barrier piston of claim 1, wherein the seal includes at least one rib radially disposed thereon.

4. An aerosol container assembly, comprising:

a container;

a valve assembly disposed on a top of the container;

a stopper sealed to a bottom of the container; and a barrier piston comprising a piston body with a base and flow channels disposed thereon, stabilizers disposed in the flow channels, a seal radially disposed on the base, the flow channels including first and second flow channels disposed perpendicularly from each other, the stabilizers each including a longitudinally oriented extension, each extension being non-circumferential and discreet from one another, each extension having an outer diameter that is longitudinally flush with an outer diameter of the seal and sized to abut an inner surface of the aerosol container, the barrier piston slidably disposed in an interior of the container between the valve assembly and the stopper, the valve assembly and the barrier piston defining a first chamber, the barrier piston and the stopper defining a second chamber.

5. The assembly of claim 4, wherein the piston body is formed of a first material with a first durometer, and the stabilizers and seal form a unitary body of a second material with a second durometer, the second durometer being less than the first durometer.

6. The assembly of claim 4, wherein the piston body is formed of a thermoplastic material, and the stabilizers and seal are formed of a thermoplastic elastomer material.

7. The assembly of claim 4, wherein a liquid product is disposed within the first chamber and a propellant is disposed within the second chamber.

* * * * *